United States Patent [19]

Pieters

[11] Patent Number: 4,493,625

[45] Date of Patent: Jan. 15, 1985

[54] GROOVED GEAR PUMP

[75] Inventor: Ferdinandus A. Pieters, Concord, Calif.

[73] Assignee: Micropump Corporation, Concord, Calif.

[21] Appl. No.: 405,893

[22] Filed: Aug. 6, 1982

[51] Int. Cl.[3] ..... F04B 17/00; F01C 1/18; F01C 19/10; F04C 1/08

[52] U.S. Cl. ..... 418/126; 418/206

[58] Field of Search ..... 418/206, 205, 126, 129

[56] References Cited

U.S. PATENT DOCUMENTS 2,403,796 9/1946 Hanna ..... 418/206

4,127,365 11/1978 Martin et al. ..... 417/420

FOREIGN PATENT DOCUMENTS 117097 8/1918 United Kingdom ..... 418/206

*Primary Examiner*—William R. Cline

*Assistant Examiner*—John J. McGlew, Jr.

*Attorney, Agent, or Firm*—Julian Caplan

[57] ABSTRACT

The drive and driven gears of a pump are formed with grooves extending inward from the tips of the teeth to inside the root diameter. Thus each gear is divided into a first portion which serves solely as a drive or driven gear and a second portion which serves the two functions of a conventional pump gear, mainly to perform the pumping function and part of the drive function. Fitting within the grooves of both gears is a suction shoe which also overlies the inlet duct of the pump block and the mesh points of the first portions of the gears plus about two teeth to either side of the mesh point. The shoe separates the large portion of the pump chamber from the inlet duct.

5 Claims, 8 Drawing Figures

GROOVED GEAR PUMP

Conventional gears for gear pumps function both to perform the pumping action and also rotational drive from the drive gear to the driven gear. Plastic gears for such pumps have limited ability to function at high pressures because of structural limitations of the plastic material. The present invention differs from such conventional pumps in that a groove is formed in each gear intermediate its width extending inward from the tips of the gear teeth to a point just inside the root diameters of such teeth, thereby dividing each gear tooth into a first portion which performs pumping and driving action and a second portion which functions solely to perform driving function. The relative widths of the two portions of the teeth is a matter of design, depending upon the pressures to which the fluid is subjected and the characteristics of the fluid being pumped. Thus, the width of the gear teeth is one variable and the location of the groove along such width is a second variable.

Accordingly, the present invention provides additional driving torque between any two pump gears without the need to construct a more costly, space consuming and expensive external driving or synchronizing mechanism.

Suction shoes of the type shown in U.S. Pat. No. 4,127,365 are used in the present invention, the edge of the shoe fitting within the groove in each gear and bearing against the bottom of the groove. The advantages of a shoe such as that shown in U.S. Pat. No. 4,127,365 is that it forms a passageway from the inlet duct in the gear block (which is covered by the shoe) to the mesh point of the gear teeth. The shoe fits over the mesh point of the gears and at least a span of two teeth to either side thereof, also fitting over the inlet duct and thus isolating this area from the main pump cavity to establish a small pump chamber within the pump cavity. Since there is a pressure differential when the pump is operating which is lower on the underside of the shoe than in the main pump cavity, the shoe is held against the pump block. The shoe separates the inlet duct from the discharge pressure, while accepting fluid flow.

Thus, an advantage of a suction shoe is greatly improved volumetric efficiency of the pump and reduction of loss of flow with rise in pressure. The other objects and advantages of suction shoes set forth in U.S. Pat. No. 4,127,365 are equally applicable in the present case.

U.S. Pat. No. 4,165,206 shows three gear pumps. Although not illustrated in the accompanying drawings, nor described herein in detail, it is believed that it will be obvious to one skilled in the art that the structure of the present invention can be used with three or more gear pumps.

Thus, a feature of the present invention is to improve the ability of pumps with relatively soft gears to pump at higher pressures.

Another feature of the invention is the elimination of timing gears within the pump cavity or external thereto.

A further feature of the invention is the interrelationship of the suction shoe and the grooves formed in the drive and driven gears.

Other objects of the present invention will become apparent upon reading the following specification and referring to the accompanying drawings in which similar characters of reference represent corresponding parts in each of the several views.

Figure 1:
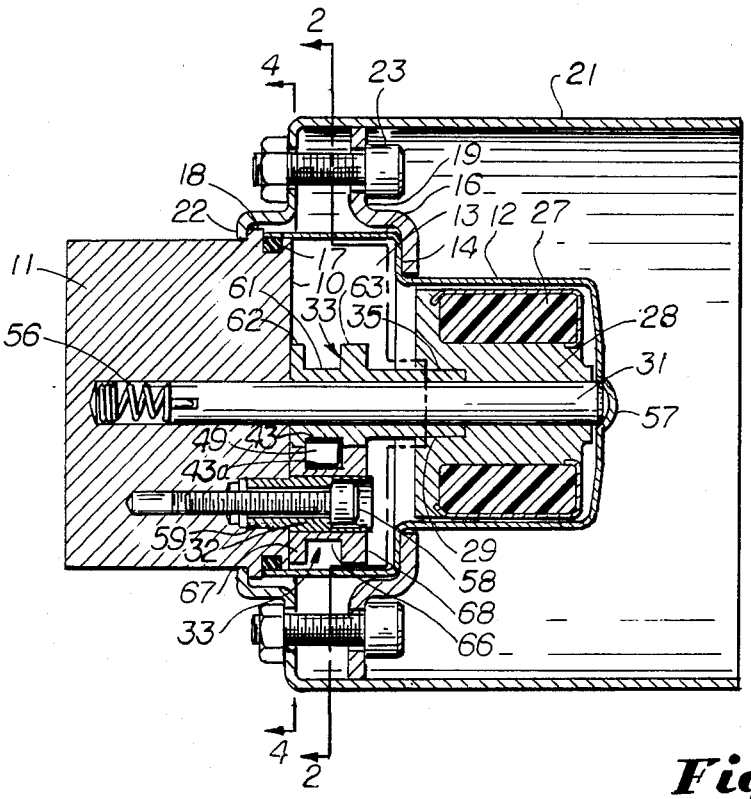
FIG. 1 is a vertical midsection through the pump.
Figure 2:
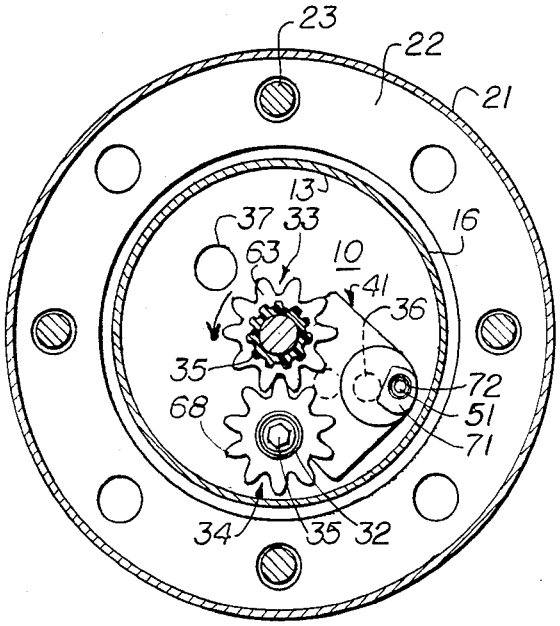
FIG. 2 is a sectional view taken substantially along the line 2—2 of FIG. 1.

Pump block 11 has a lapped inner face 10 which functions along with cup-like member 12 to define a pump cavity 13. Cup 12 is formed with a shoulder 14 and an enlarged diameter portion 16 which fits over the outside of block 11. An O-ring 17 is recessed into an appropriate groove in the outside of block 11 to seal against enlarged diameter portion 16. Immediately beyond O-ring 17 is a flange 18 formed on the exterior of block 11. Ring 19 fits against the outside of shoulder 14 and its periphery fits within sleeve 21. The inner end of ring 21 has a flange 22 which engages behind flange 18. Bolts and nuts 23 which are angularly spaced around the periphery of ring 19 draw the ring and sleeve 21 together and hold cup 12 in position against one side of flange 17. Sleeve 21 is useful in locating the drive motor (not shown) and the drive magnet (also not shown).

Driven magnet 27 is located wthin cup 12 and supported by magnet holder 28 formed at one end with a splined bore 29. Main pin 31 is received in an appropriate bore in block 11 and also in the bore of holder 28. Spring 56 in the bottom of the bore in the block biases the pin 31 outwardly and its outer end fits within a dimple 57 in the end of cup 12. The drive magnet which is clearly shown in U.S. Pat. No. 4,127,365 as it is turned by the motor causes the magnet 27 and holder 28 to revolve. Drive gear 33 has a splined hub 35 which fits within the splined bore 29. Hence, as the magnet 27 is rotated, the gear 33 is likewise rotated.

Driven gear 34 has a support 32 having an elongated hub 59 which fits within an appropriate bore in block 11. Screw 58 is threaded through hub 59 and into a tapped hole in block 11. Thus, driven gear 34 rotates about stationary support 32 while drive gear 33 rotates about pin 31.

Formed in block 11 is an inlet duct 36 and also formed in block 11 is an outlet duct 37 which communicates with the pump cavity 13. Inlet and outlet ports 38 and 39 are formed in block 11 and communicate with ducts 36 and 37, respectively.

An important feature of the present invention is the formation of a groove 61 in drive gear 33 extending from the tips of the teeth thereof to a location slightly inward of the root diameter of the teeth. Thus, each tooth of the gear 33 is divided into a first portion 62 which performs, as hereinafter explained, both a pumping and a driving function and a second portion 63 which performs only a driving function. The width of groove 61 depends upon the dimensions of shoe 41 hereinafter described. The distance of the groove 61 from the face 10 determines the relative widths of the portion 62 and 63 and is a matter of design depending upon the pressure of the fluid being pumped and the characteristics of the fluid, particularly viscosity. The portions 62 are the only portions subjected to pumping pressure. Particularly in the case of soft plastic gears, this feature of the invention permits higher pumping pressure.

Driven gear 34 is also formed with a groove 66 identical in width and location to the groove 61 in gear 33. Groove 66 divides the teeth of driven gear 34 into a pump and gear portion 67 and a driven only portion 68. The portions 62 and 67 mesh and the portions 63 and 68 also mesh. Since the gears 33 and 34 are, preferably, each integral, there is no problem of synchronization between the pump and drive portions and the drive only portions.

Figure 8:
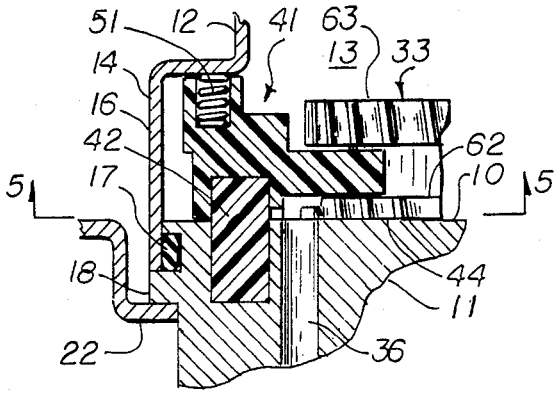
FIG. 8 is an enlarged fragmentary view of a portion of the pump.
Figure 3:
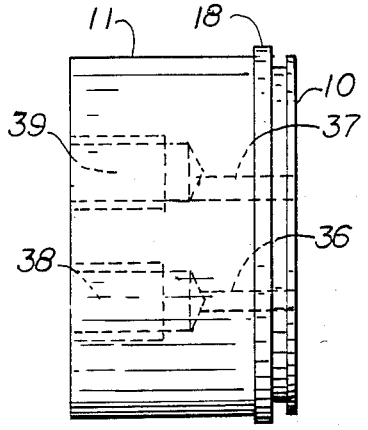
FIG. 3 is a plan view of pump body in one of its various forms.
Figure 5:
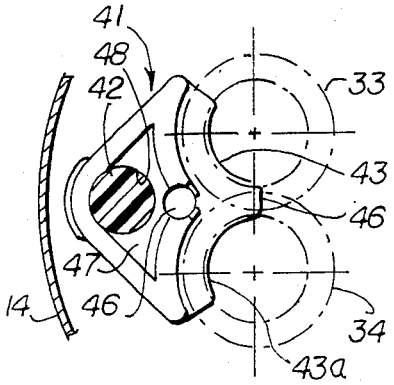
FIG. 5 is a plan view of the underside of the shoe.
Figure 7:
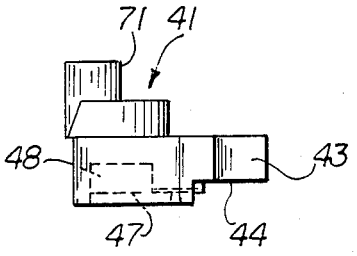
FIG. 7 is a view from the right hand side of FIG. 5.
Figure 4:
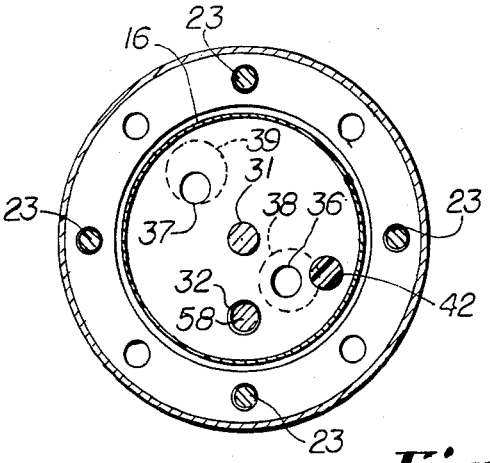
FIG. 4 is a view taken substantially along the line 4—4 of FIG. 1.
Figure 6:
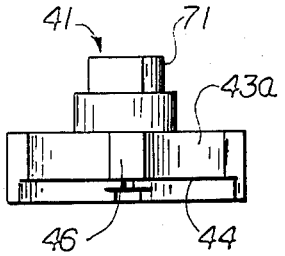
FIG. 6 is a view from the top of FIG. 5.

Shoe 41 is modified somewhat from the construction of the shoe shown when the aforesaid U.S. Pat. No. 4,127,365, but functions in essentially the same manner. The shoe 41 is mounted on the block 11 by means of a third pin 42 recessed into face 10. Directing attention now particularly to FIGS. 5–8, the edge of shoe 41 opposite the location of pin 42 is formed in two arcs 43 and **43*a* for clearance for the bottoms of the groove 61 and 66, respectively. The portion of edge 49 between arcs 43 and 43*a* extends between the gears 33 and 34 and covers the mesh points of the teeth portions 62 and 67** thereof, plus about two teeth to either side of the mesh point.

The underside of shoe 41 is formed with a recess 44 having a depth equal to the width of portions 62 and 67 of gears 33 and 34 and fitting over the mesh points thereof, plus two teeth to either side thereof. A deeper recess 46 is directly opposite the pump inlet duct 36 in block 11. A bore 48 in the underside of shoe 41 receives the pin 42.

On the outside of shoe 41 is a boss 71 formed with a bore 72 in which fits a coil spring 51 which bears against the shoulder 14 of cup 12. (See FIG. 8) Thus, the spring 51 holds the shoe 41 tight against the face 10 until such time as the gears have built up sufficient speed so that the pressure beneath the shoe 41 is less than the pressure within the pump cavity 13. The operating differential pressure functions to supplement or replace the pressure of spring 51 thereafter.

In operation, at the outset, the spring holds the shoe 41 against the face 10. As the motor (not shown) turns the drive magnet (also not shown) magnet 27 revolves around stationary main pin 31 causing the gear 33 to turn and to cause a corresponding revolution of the gear 33. The portion 62, 67 of the teeth of the gears 33 and 34, as they pass their mesh points under the shoe 41, cause fluid entering the pump cavity 13 through inlet duct 36 to be increased in pressure and discharged into the pump cavity 13 and outlet duct 37. The increased pressure in the cavity 13 as compared with the reduced pressure under the shoe 41 causes the shoe 41 to engage the face 10 independent of the spring 51.

The gears 33 and 34 illustrated in the accompanying drawings are shown as spur gears. It will be understood that the gear may be helical. The gears are molded, preferably of a thermoplastic. The width of the grooves 61 and 66 is slightly wider than the thickness of the shoe 41 immediately inward of the arcs 43, **43*a*. Said arcs are tangent to the bottoms of the grooves 61, 63. The widths of the grooves and their distance from the ends of the gears is a matter of design choice. Only the teeth which are in the act of meshing with the teeth of the opposite gear and which are in the portions 62, 67—i.e., under the shoe 41—are subject to the high pressure differential of the pump and thus subjected to such stress. The teeth in the gear portions 63, 68** are not subjected to such pressure differential.

The driving action of the gears 33, 34 is along the total available lengths of the gear teeth. The pumping action or load on the gear teeth goes only as the length of the pumping sections 62, 67 of the teeth. Therefore, the load due to pumping is shared by both sections of the gear and is therefore proportionately reduced, allowing the pump to handle higher pressures with reduced stress. In the case of a pump whose gear teeth for other reasons are constrained to be made of a relatively soft material such as plastic, the pressure producing ability of such a pump is enhanced without materially altering the design of the pump or its installation or its costs.

What is claimed is:

1. In a pump of the type having first means defining:

a pump chamber having a face having a planar first surface, a unitary drive gear and a unitary driven gear in said chamber each having planar second and third surfaces, said second surfaces bearing and sealing against said first surface, said gears meshing together at a mesh point, second means for driving said drive gear, an inlet duct in said face, a concave shoe in said chamber overlying said inlet duct and a portion only of each of said gears including said mesh point, third means mounting said shoe on said face, said shoe having:

a planar fourth surface sealing against said first surfaces and an outlet duct in said chamber remote from said shoe, the improvement which comprises a first groove formed in said drive gear extending inward from the tips of the teeth of said drive gear to inside the root diameter of said teeth, the wall of said first groove closest to said second surface defining a planar fifth surface, said first groove dividing the teeth of said drive gear into a pumping first section and a second section, a second groove formed in said driven gear extending inward from the tips of the teeth of said driven gear to inside the root diameter of said teeth, the wall of said second groove closest to said second surface defining a planar sixth surface, said second groove dividing the teeth of said drive gear into a pumping third section and a fourth section, said second and fourth sections being located in said chamber, said shoe further having a seventh surface sealing against portions of said fifth and sixth surfaces on either side of said mesh point, an arcuate eighth surface sealing against some of the tips of said first and third sections adjacent said mesh point, and whereby said first surface, said shoe, said first and third section and the bottoms of said grooves define a closed chamber around said inlet duct separate from said cavity said second and fourth sections being totally separated from said inlet duct by said shoe.

2. A pump according to claim 1 in which said shoe comprises a member formed with a first recess providing space for rotation of said first and third sections and a second recess communicating with said first recess and said inlet duct.

3. A pump according to claim 1 which further comprises a spring in said chamber between said first means and said shoe biasing said shoe into close contact with said first, fifth and sixth surfaces.

4. A pump according to claim 1 in which said face is a part of a pump block, a first pin in said block being part of said second means, fourth means in said block rotatably mounting said driven gear and fifth means on said block being part of said third means.

5. A pump according to claim 4 which further comprises a driven magnet within said pump chamber, sixth means mounting said driven magnet on said first pin, said sixth means and said drive gear being fixed for rotation together.

* * * * *